US008512550B2

(12) United States Patent
Rose et al.

(10) Patent No.: US 8,512,550 B2
(45) Date of Patent: Aug. 20, 2013

(54) REFINERY CRUDE UNIT PERFORMANCE MONITORING USING ADVANCED ANALYTIC TECHNIQUES FOR RAW MATERIAL QUALITY PREDICTION

(75) Inventors: Arthur H. Rose, Clifton, VA (US); James M. Brown, Flemington, NJ (US); Gregory M. Martin, Centreville, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1257 days.

(21) Appl. No.: 11/200,489

(22) Filed: Aug. 9, 2005

(65) Prior Publication Data

US 2006/0043004 A1 Mar. 2, 2006

Related U.S. Application Data

(60) Provisional application No. 60/604,169, filed on Aug. 24, 2004.

(51) Int. Cl.
*C10G 7/00* (2006.01)

(52) U.S. Cl.
USPC ..... 208/347; 702/30; 702/85

(58) Field of Classification Search
USPC ..... 208/347; 702/30, 85
See application file for complete search history.

(56) References Cited

U.S. PATENT DOCUMENTS

| | | | | |
|---|---|---|---|---|
| 5,121,337 | A | 6/1992 | Brown | |
| 5,132,918 | A * | 7/1992 | Funk | 700/270 |
| 5,452,232 | A * | 9/1995 | Espinosa et al. | 702/30 |
| 5,699,269 | A * | 12/1997 | Ashe et al. | 702/30 |
| 6,223,133 | B1 * | 4/2001 | Brown | 702/85 |
| 6,490,029 | B1 * | 12/2002 | Cho et al. | 356/70 |
| 6,662,116 | B2 * | 12/2003 | Brown | 702/22 |

FOREIGN PATENT DOCUMENTS

EP 0 859 236 A1 * 8/1998

OTHER PUBLICATIONS

Waguespack et al., "Manage Crude Oil Quality for Refining Profitability", Hydrocarbon Processing, (Sep. 1998).
Bro et al., "A Fast Non-Negativity-Constrained Least Squares Algorithm", Journal of Chemometrics, vol. 11, pp. 393-401 (1997).
Lawson et al., "Solving Least Squares Problems", Society for Industrial and Applied Mathematics, Chapter 23, pp. 158-173 (1995).

* cited by examiner

*Primary Examiner* — Prem C Singh
*Assistant Examiner* — Michelle Stein
(74) *Attorney, Agent, or Firm* — Ronald D. Hantman

(57) ABSTRACT

A method for the determination of optimal pipestill operation comprising the steps of: feeding a crude oil feedstream into the pipestill wherein the crude oil feedstream is separated into boiling range fractions, performing a virtual assay of the crude oil feedstream to determine predicted boiling range fraction yields, comparing the predicted boiling range fraction yields with the actual boiling range fraction yields from the pipestill to determine differences between these fraction yields, relating the difference between the fraction yields with the operation of the pipestill.

8 Claims, 1 Drawing Sheet

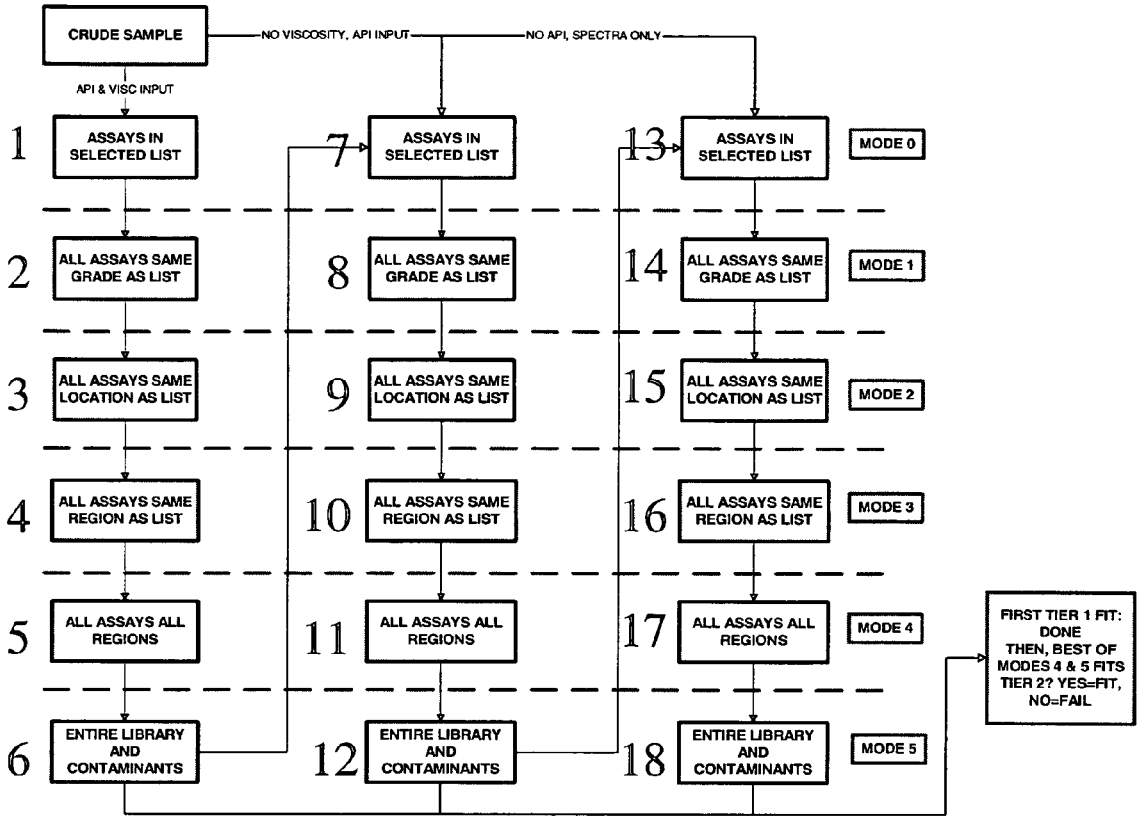
CRUDE SAMPLE
NO VISCOSITY, API INPUT
NO API, SPECTRA ONLY
API & VISC INPUT
1
ASSAYS IN SELECTED LIST
2
ALL ASSAYS SAME GRADE AS LIST
3
ALL ASSAYS SAME LOCATION AS LIST
4
ALL ASSAYS SAME REGION AS LIST
5
ALL ASSAYS ALL REGIONS
6
ENTIRE LIBRARY AND CONTAMINANTS
7
ASSAYS IN SELECTED LIST
8
ALL ASSAYS SAME GRADE AS LIST
9
ALL ASSAYS SAME LOCATION AS LIST
10
ALL ASSAYS SAME REGION AS LIST
11
ALL ASSAYS ALL REGIONS
12
ENTIRE LIBRARY AND CONTAMINANTS
13
ASSAYS IN SELECTED LIST
14
ALL ASSAYS SAME GRADE AS LIST
15
ALL ASSAYS SAME LOCATION AS LIST
16
ALL ASSAYS SAME REGION AS LIST
17
ALL ASSAYS ALL REGIONS
18
ENTIRE LIBRARY AND CONTAMINANTS
MODE 0
MODE 1
MODE 2
MODE 3
MODE 4
MODE 5
FIRST TIER 1 FIT: DONE
THEN, BEST OF MODES 4 & 5 FITS TIER 2? YES=FIT, NO=FAIL

REFINERY CRUDE UNIT PERFORMANCE MONITORING USING ADVANCED ANALYTIC TECHNIQUES FOR RAW MATERIAL QUALITY PREDICTION

CROSS-REFERENCE TO RELATED APPLICATION

This application claims the benefit of U.S. Provisional application 60/604,169 filed Aug. 24, 2004.

BACKGROUND OF THE INVENTION

The present invention is a method to determine if a crude-oil pipestill is operating optimally for the particular crude-oil feedstream that is being fed to the pipestill.

All crude oils have varying quantities of material in their boiling range fractions, and each fraction will have different physical properties that are determined by the specific molecular species present. The combination of these two factors, volume and physical properties, determine the overall quality of a crude and is a significant factor in determining the value for the material. The crude quality is also used to define the operational settings for a refinery as that crude oil is processed.

In the petrochemical industry, crude quality had traditionally been assessed using a crude assay. When a crude oil is assayed, it is distilled in two steps. A method such as ASTM D2892 (see Annual Book of ASTM Standards, Volumes 5.01-5.03, American Society for Testing and Materials, Philadelphia, Pa.) is used to isolate distillate cuts boiling below approximately 650° F. (343° C.). The residue from this distillation is further distilled using a method such as ASTM D5236 to produce distillate cuts covering the range from 650° F. to approximately 1000-1054° F. (343° C. to 538-568° C.) and a vacuum residue cut. At a minimum, cuts corresponding to typical products or unit feeds are typically isolated, including LPG (Initial Boiling Point to 68° F.), LSR (68-155° F.), naphtha (155-350° F.), kerosene (350-500° F.), diesel (500-650° F.), vacuum gas oil (650° F. to 1000-1054° F.), and vacuum residue (1000-1054° F.+). Each distillate cut is then analyzed for elemental, molecular, physical and/or performance properties. The specific analyses conducted depend on the typical disposition of the cut. The data derived from these analyses will typically be stored in an electronic database where it can be mathematically manipulated to estimate crude qualities for any desired distillation range. Commercial crude assay libraries are available from Haverly Systems Inc., and HPI Consultants Inc., both of which provide tools for manipulating the data, as does Aspentech Inc. Assay data is published by Crude Quality Inc., by Shell Oil Company, and by Statoil. The property versus distillation temperature data is typically fit to smooth curves that can then be used to estimate the property for any desired distillation cut.

A detailed crude assay can take several weeks to months to complete. As a result, the assay data used for making business decisions, and for planning, controlling and optimizing operations is typically not from the cargoes currently being bought, sold or processed, but rather historical data. The assays do not account for variations between cargoes that can have a significant effect on operations. K. G. Waguespack (*Hydrocarbon Processing,* 77 (9), 1998 Feature Article) discusses the sources of oil quality variation, their effect on refinery operations, and the need for improved analytical technology for use in crude oil quality monitoring. Wagusepack lists sources of crude oil variability, both over time and during its transport life as: aging production reservoirs; changes in relative field production rates; mixing of crude in the gathering system; pipeline degradation vis-à-vis batch interfaces; contamination; and injection of significantly different quality streams into common specification crude streams. Such variations can cause significant changes in the value of the crude oil, and in the products that can be made from it.

Refinery Crude Units, also referred to as Pipestills, separate crude oils into their constituent boiling range fractions at different boiling point temperatures (cut points) that then become feeds to other refinery process units or for blending into finished petroleum products. The respective cut points are determined by economic factors as well as the quantity of material anticipated to be available in each of the boiling range fractions. Refinery operation is optimized to maximize recovery of the highest valued streams and products as determined by sophisticated mathematical models of the plant operation using the most recent crude assay.

Deviations from the optimum operation can be costly and units are constantly monitored to keep them within the operating targets. As deviations are observed, plant personnel attempt to understand the underlying causes so that they may be corrected. There are many possible causes for these deviations. These may include mechanical problems, such as fouling of distillation tower internals and/or associated heat exchanger equipment, mechanical damage to tower internals, and faulty instrumentation. The deviation can also be caused by incorrect control settings. Identifying the root cause for the deviation may be a difficult and time-consuming task. Complicating the analysis is that while optimum operation is determined using a laboratory assay, the delivered crude qualities can deviate, sometimes significantly, from those specified in the assay. In addition, feed streams are often a blend of different crudes and the precise percentage of each crude in the blend may not be known with a high degree of accuracy. Plant personnel must decide whether the deviation is due to sub-optimal plant operation or is the result of the normal variation in crude quality and/or make up of the crude blend. This uncertainty can result in delays or inaction towards rectifying underlying operational problems resulting in continued sub-optimal operation. The ability to confirm or eliminate crude quality as an underlying cause for the observed deviation can therefore accelerate problem resolution.

SUMMARY OF THE INVENTION

The optimal operation of a refinery crude unit requires that plant personnel accurately describe the quality of the crude feeding the unit so that deviations from the optimum can be identified. This then allows the underlying cause for deviations that may occur to be properly investigated and rectified through operational changes as necessary. Crude quality is typically determined by performing a laboratory assay on the crude. Crude quality may be highly variable and it is impractical to routinely measure cargoes with a laboratory assay due to their relatively high cost and the time it takes to perform a laboratory assay. The inability to accurately describe the actual yields expected from the material feeding a crude unit adds uncertainty to the analysis and may result in an incorrect conclusion.

The present invention is a method to determine if a pipestill is operating optimally for a given crude oil feedstream by performing a virtual assay on the crude oil instead of a laboratory assay. This requires that multivariate analytical data be obtained on the crude oil as described in U.S. Pat. No. 6,662,116B2, which is incorporated herein by reference. The method of U.S. Pat. No. 6,662,116B2 will henceforth be referred to as Virtual Assay. Thus, the present invention allows the determination of the "health" of the pipestill prior to performing any physical or mechanical tests on the pipestill.

Virtual Assay overcomes this uncertainty by providing a method to determine crude quality accurately and quickly for use in this deviation analysis. Virtual Assay as described in U.S. Pat. No. 6,662,116 is a method for analyzing an unknown material using a multivariate analytical technique such as spectroscopy, or a combination of a multivariate analytical technique and inspections. Such inspections are physical or chemical property measurements that can be made cheaply and easily on the bulk material, and include, but are not limited to, API gravity or specific gravity and viscosity. The unknown material is analyzed by comparing its multivariate analytical data (e.g. spectrum) or its multivariate analytical data and inspections to a database containing multivariate analytical data or multivariate analytical data and inspection data for reference materials of the same type. The comparison is done so as to calculate a blend of a subset of the reference materials that matches the containing multivariate analytical data or containing multivariate analytical data and inspections of the unknown. The calculated blend of the reference materials is then used to predict additional chemical, physical or performance properties of the unknown using measured chemical, physical and performance properties of the reference materials and known blending relationships.

In applying Virtual Assay for crude unit health monitoring, it is necessary to optimize the Virtual Assay database (library) for the application to allow the analyst to determine if the quality of the Virtual Assay predictions is adequate for the health determination. The optimization involves setting inspection weightings and fit quality cutoff to define a range of analyses, wherein referred to as Tier 1 fits, for which the predicted crude properties are deemed to be of sufficient quality for use in the health determination.

BRIEF DESCRIPTION OF THE DRAWING

FIG. 1 shows a schematic for predicting crude assay data.

DETAILED DESCRIPTION OF THE PREFERRED EMBODIMENTS

Crude Unit process monitoring compares actual yields and key qualities with those that are predicted using the refinery optimization models, scheduling applications or assay delivery tools. Suitable software packages for predicting yields and qualities include, but are not limited to the Advance Refinery Modeling System sold by MathPro, Inc., the ORION™ and PIMS™ sold by AspenTech, and Assay Simulator sold by HPI Consultants, Inc. Many oil companies have similar "in-house" systems. Deviations are then investigated to determine whether they are due to actual unit operation not being properly configured, equipment problems, or simply due to feed quality that is different than expected.

Without Virtual Assay, the plant will have little data upon which to determine whether feed quality is the cause of the deviation. A laboratory assay is relatively expensive and can take several weeks to months to complete. It is therefore impractical to perform a laboratory assay for each cargo or batch of crude that is received. Plant personnel therefore rely on readily measurable properties such as the API gravity of the received cargo to determine whether the crude is different from the expected quality as based on the most recent laboratory assay that may have been performed months or years earlier. However, while the difference in API gravity may indicate that the crude has changed, it is not sufficient to determine how the specific yield pattern of the crude has changed. This uncertainty may lead refinery personnel to conclude that crude quality is the likely cause of plant deviations thereby effectively masking other underlying causes, which will go unresolved. Virtual Assay eliminates this uncertainty by providing the capability to quickly, and inexpensively determine the yield pattern of a given crude unit feed with a high degree of accuracy.

Virtual Assay overcomes this uncertainty by providing a method to determine crude quality accurately and quickly for use in this deviation analysis. Virtual Assay as described in U.S. Pat. No. 6,662,116 is a method for analyzing an unknown material using a multivariate analytical technique such as spectroscopy, or a combination of a multivariate analytical technique and inspections. Such inspections are physical or chemical property measurements that can be made easily and inexpensively relative to a laboratory assay on the bulk material, and include but are not limited to API or specific gravity and viscosity. The unknown material is analyzed by comparing its multivariate analytical data (e.g. spectrum) or its multivariate analytical data and inspections to a database containing multivariate analytical data or multivariate analytical data and inspection data for reference materials of the same type. The comparison is done so as to calculate a blend of a subset of the reference materials that matches the containing multivariate analytical data or containing multivariate analytical data and inspections of the unknown. The calculated blend of the reference materials is then used to predict additional chemical, physical or performance properties of the unknown using measured chemical, physical and performance properties of the reference materials and known blending relationships.

Virtual Assay preferably utilizes FT-MIR spectral data in the 7000-400 $cm^{-1}$ spectral range. Spectra are preferably collected using 0.25 mm nominal pathlength cells with $CaF_2$ windows. Discontinuous spectral regions are typically selected from this spectra so as to avoid data where the absorbance exceeds the linear response range of the spectrometer, and regions where the spectral variation and thus information content is low. The spectral data is corrected for extraneous signals using a orthogonalization procedure described in Brown (U.S. Pat. Nos. 5,121,337 and 6,662,116). These extraneous signals represent signals that do not arise from the organic components of the sample, and include baseline variations, absorptions due to spectrometer purge contaminants such as water vapor, and, in the case of crude oils, water that is dissolved or dispersed in the crude sample. The corrected spectral data is preferably augmented with inspection data. The inspection data is converted to a linearly blendable form, weighted, and concatenated to the end of the spectral vector. For example, API gravity will be converted to specific gravity and viscosity to a viscosity blending number. The augmented, corrected spectral vector for the unknown crude being analyzed is fit as a linear combination of augmented, corrected spectral vectors for reference crudes preferably using a Fast NonNegative Least Squares algorithm. A suitable algorithm is described by C. L. Lawson and R. J. Hanson (*Solving Least Squares Problems*, SIAM, 1995). A preferred algorithm is described by R. Bro and S. De Jong (*Journal of Chemometrics*, Vol. 11, 393-401, 1997). The Fast NonNegative Least Squares algorithm may be used within an iterative algorithm that adjusts scaling of the spectral part of the augmented vector until the coefficients for the blend sum to a value sufficiently close to one. The analysis produces what is referred to as a Virtual Blend, a recipe of reference crudes whose augmented spectral vectors when added in the indicated proportions most closely matches the augmented spectral vector for the unknown crude being analyzed. The Virtual Assay is produced by blending the assay data for these the reference crudes in the same indicated proportions using known blending relationships. The predictions may be done using software designed to calculate qualities for real blends of materials. Software capable of doing these "blend" calculations is commercially available from Haverly Systems Inc., HPI Consultants Inc., and Aspentech Inc. Many oil companies have similar "in-house" systems.

Statistical tools are used to evaluate the quality of the fit, and thereby the expected quality of the assay predictions. Various statistics can be used to measure the agreement between the augmented, corrected spectral vector for the unknown crude being analyzed, and the linear combination of the augmented, corrected spectral vectors for the reference crudes. Once such statistic is called a Fit Quality Ratio. The Fit Quality Ratio is calculated by the following procedure:

Step 1: Calculation of $R^2$

If the Virtual Blend is calculated using unaugmented spectral data, then $R^2$ is calculated according to [1].

$$R^2 = 1 - \frac{(\hat{x}_u - sx_u)^T(\hat{x}_u - sx_u)/(f-c-1)}{(sx_u - \overline{sx}_u)^T(sx_u - \overline{sx}_u)/(f-1)} \quad [1]$$

$x_u$ is the corrected spectral vector for the unknown crude being analyzed, and $\hat{x}_u$ is the calculated corrected spectrum for the "virtual blend". f is the number of frequency points per spectral vector and c is the number of non-zero coefficients for the blend. S is the iteratively determined factor used to scale the spectral data such that the coefficients sum to one. Transpose is indicated by the superscript t.

If API Gravity and viscosity augmented spectral vectors are used, $R^2$ is calculated as $$R^2 = 1 - \frac{\left(\begin{bmatrix}\hat{x}_u \\ w_{API}\hat{\lambda}_{u(API)} \\ w_{Visc}\hat{\lambda}_{i(Visc)}\end{bmatrix} - \begin{bmatrix}sx_u \\ w_{API}\lambda_{u(API)} \\ w_{Visc}\lambda_{u(Visc)}\end{bmatrix}\right)^T \left(\begin{bmatrix}\hat{x}_u \\ w_{API}\hat{\lambda}_{u(API)} \\ w_{Visc}\hat{\lambda}_{u(Visc)}\end{bmatrix} - \begin{bmatrix}sx_u \\ w_{API}\lambda_{u(API)} \\ w_{Visc}\lambda_{u(Visc)}\end{bmatrix}\right) \Big/ (f+2-c-1)}{\left(\begin{bmatrix}sx_u \\ w_{API}\lambda_{u(API)} \\ w_{Visc}\lambda_{u(Visc)}\end{bmatrix} - \begin{bmatrix}sx_u \\ w_{API}\lambda_{u(API)} \\ x_{Visc}\lambda_{u(Visc)}\end{bmatrix}\right)^T \left(\begin{bmatrix}sx_u \\ w_{API}\lambda_{u(API)} \\ w_{Visc}\lambda_{u(Visc)}\end{bmatrix} - \begin{bmatrix}sx_u \\ w_{API}\lambda_{u(API)} \\ w_{Visc}\lambda_{u(Visc)}\end{bmatrix}\right) \Big/ (f+2-1)} \quad [2]$$

$\lambda_u^{(api)}$ and $\lambda_u^{(visc)}$ are the volumetrically blendable forms of API and viscosity, and $w_{API}$ and $w_{visc}$ are the weighting factors for the two inspections. $\hat{\lambda}_u^{(api)}$ and $\hat{\lambda}_u^{(visc)}$ are the estimated blendable forms of API and viscosity calculated based on the Virtual Blend. A similar expression for $R^2$ is used if volumetrically blendable forms of API or viscosity are used separately in the analysis.

Step 2:

A Fit Quality, FQ, is calculated as:

$$FQ = c^{\epsilon}\sqrt{1-R^2} \quad [4]$$

c is the number of nonzero coefficients for components in the Virtual Blend. The exponent $\epsilon$ can be set to zero such that the Fit Quality depends only on $R^2$, but it is preferably set to a value on the order of 0.25.

Step 3:

The Fit Quality Ratio, FQR, is calculated as:

$$FQR = \frac{FQ}{FQC} \quad [5]$$

FQC is a Fit Quality Cutoff. FQC is selected such that analyses with FQR≦1.0 will produce predictions of adequate precision for the intended application. Note that the values for FQC will differ depending on which inspections are used in the analysis. Analyses for which FQR≦1.0 are referred to as Tier 1 analyses. The weighting for the inspections in the augmented vector are adjusted to achieve a desired precision over the Tier 1 fits. Procedures for adjusting FQC and the weightings for the inspections are discussed in Appendix 1.

The Virtual Assay analysis is preferably conducted according to a scheme shown in FIG. 1 Assuming that the API Gravity and viscosity for the unknown have been measured, the analysis scheme starts at point 1. The user may supply a specific set of references to be used in the analysis. Fits are conducted according to the three steps described in Appendix 1. An FT-IR only based fit (step 1) and an FT-IR & API based fit (step 2) are calculated, but they are not evaluated at this point. If the fit based on FT-IR, API Gravity and viscosity produces a Tier 1 fit, the analysis is complete and the results are reported.

If the analysis at point 1 does not produce a Tier 1 fit, then the process proceeds to point 2. The reference set is expanded to include all references that are of the same crude grade(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 2 does not produce a Tier 1 fit, then the process proceeds to point 3. The reference set is expanded to include all references that are from the same location(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 3 does not produce a Tier 1 fit, then the process proceeds to point 4. The reference set is expanded to include all references that are from the same region(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 4 does not produce a Tier 1 fit, then the process proceeds to point 5. The reference set is expanded to include all references crudes. The three-step analysis is again conducted, and the analysis based on FT-IR, API Gravity and viscosity is examined. If this analysis produces a Tier 1 fit, the analysis is complete and the results are reported.

If the analysis at point 5 does not produce a Tier 1 fit, then the process proceeds to point 6. The reference set is expanded to include all references crudes and contaminants. The three-step analysis is again conducted, and the analysis based on FT-IR, API Gravity and viscosity is examined. If this analysis produces a Tier 1 fit, the analysis is complete and the results are reported, and the sample is reported as being contaminated. If the contamination does not exceed the maximum allowable level, assay results may still be calculated and Confidence Intervals estimated based on the fit FQR. If the contamination does exceed the allowable level, the results may be less accurate than indicated by the FQR.

If the analysis at point 6 does not produce a Tier 1 fit, then the fits based on FT-IR and API Gravity (from Steps 2 at each points) are examined to determine if any of these produce Tier 1 fits. The fit for the selected references are examined first (point 7). If this analysis produced a Tier 1 fit, the analysis is complete and the results are reported. If not, the process continues to point 8, and the fit based on crudes of the same grade(s) as the selected crudes using FT-IR and API Gravity are examined. The process continues checking fits for point 9 (crudes of same location(s)), point 10 (crudes of same region (s)), point 11 (all crudes) and point 12 (all crudes and contaminants), stopping if a Tier 1 fit is found or otherwise continuing. If not Tier 1 fit is found using FT-IR and API Gravity, FT-IR only fits (from Step 1 at each point) are examined, checking fits for point 13 (selected references), point 14 (same grades), point 15(same locations), point 16 (same regions), point 17 (all crudes) and point 18 (all crudes and contaminants), stopping if a Tier 1 fit is found or otherwise continuing.

If no Tier 1 fit is found, the analysis that produces the highest FQR value is selected and reported. If the FQR value is less than or equal to 1.5, the result is reported as a Tier 2 fit. Otherwise, it is reported as a failed fit.

If Viscosity data is not available, the analysis scheme would start at point 7 and continue as discussed above. If neither viscosity nor API gravity was available, the analysis scheme would start at point 15 and continue as discussed above.

Example 1

Example 1 demonstrates how a Virtual Assay Library is generated and optimized for use in Pipestill Health Monitoring. More details on the calculation and optimization methodology is given in Appendix 1.

A Virtual Assay library is generated using FT-MIR spectra for 504 crude oils using the methodology described in U.S. Pat. No. 6,662,116 and in Appendex 1. Spectral data in the 4685.2-3450.0, 2238.0-1549.5 and 1340.3-1045.2 $cm^{-1}$ regions are used. Lengendre polynomials are used in each region to correct for baseline variation. Fifth order (quartic) polynomials are used in the higher frequency region, and fourth order (cubic) polynomials in the other two regions. Corrections are also generated for water vapor, and liquid water dispersed in the crude oil. The difference spectra used to generate the spectrum of liquid water are smoothed to reduce their noise level prior to generating the correction vectors. A total of 17 orthogonal correction vectors are generated including the 13 polynomials, 2 water vapor corrections, and 2 liquid water corrections. The spectra for the 504 crude oils are orthogonalized to the 17 correction vectors. The spectral variables are augmented with volumetrically blendable inspections: API gravity is converted to specific gravity and Viscosity at 40° C. to a viscosity blending index. The volumentrically blendable inspection data is weighted as discussed herein below. During analysis, the spectrum for an unknown crude would be orthogonalized to the 17 corrections, augmented with the same weighted, volumetrically blendable inspections, and analyzed as a nonnegative linear combination of the augmented spectra for these 504 reference crudes.

The specific gravity is weighted by dividing by the reproducibility and multiplying by a weighting parameter. The reproducibility for the viscosity measurement is assumed to be 7% relative. The reproducibility for the viscosity blending index is calculated by converting the viscosity of the sample being analyzed plus and minus 3.5% relative to a viscosity blending index and taking the absolute difference between the two calculated indices. The viscosity blending index is divided by this calculated reproducibility and multiplied a weighting parameter.

The FQC value and the weighting parameters for the inspection data are determined using a cross validation procedure. Each of the 504 crudes is taken out of the library and analyzed as if it were an unknown crude using the 503 remaining references. The process is repeated 504 times until each crude is analyzed once using references of the same grade as the crude that was left out, once using references that are from the same location as the crude that was left out, once using references that are from the same region as the crude that was left out, and once using all crudes in the library. For each analysis, a "Virtual Blend" is calculated and a "Virtual Assay" predicted. The Virtual Assay predictions are compared to the measured wet assay data for selected properties. For pipestill health monitoring, volume percentage yields for various distillation cuts are predicted and used to set FQC and the weighting parameters using procedures discussed in Appendix 1.

The cross validation procedure is repeated using different values for FQC and the weighting parameters until the desired performance is achieved. For this example, the target performance was that the average yield predictions be within 1.5 volume percent 90% of the time for Tier 1 analyses (analyses with FQR≦1.0). The standard error of cross validation is calculated for each distillation cut, multiplied by the appropriate t statistic and averaged. The weightings for the inspections are independently adjusted so that the prediction errors for API Gravity and viscosity for the Tier 1 analyses are comparable to the reproducibilities of the inspection measurements. For the library in this example, an FQC value of 0.007989 and weighting parameters of 1.4 for API Gravity and 3.2 for viscosity were used to generate the data shown in Table 1. 260 of the 504 crudes produce Tier 1 analyses.

Depending on the intended application, different distillation cuts and additional properties can be used in setting FQC. Different probability levels can also be used for selecting the t statistic. For instance, if a 95% probability level is used, fewer Tier 1 fits will be obtained, but closer agreement will be achieved between the VA predictions and the wet assay measurements.

TABLE 1

Virtual Assay Prediction of Volume Percentage Yields for Tier 1 Analyses

| Distillation Cut | Boiling Range Degrees Fahrenheit | Standard Error of Cross Validation | t × SECV |
|---|---|---|---|
| Light Virgin Naphtha | Initial Boiling Point-160 | 0.9 | 1.7 |
| Medium Virgin Naphtha | 160-250 | 0.7 | 1.4 |
| Heavy Virgin Naphtha | 250-375 | 0.8 | 1.6 |
| Kerosene | 320-500 | 1.0 | 2.0 |
| Jet | 360-530 | 0.9 | 1.7 |
| Diesel | 530-600 | 0.7 | 1.3 |
| Light Gas Oil | 530-700 | 0.9 | 1.8 |
| Light Vacuum Gas Oil | 700-800 | 0.5 | 0.9 |
| Medium Vacuum Gas Oil | 800-900 | 0.4 | 0.9 |
| Heavy Vacuum Gas Oil | 900-1050 | 0.5 | 1.0 |
| Vacuum Resid 1 | 1050+ | 0.8 | 1.5 |
| Vacuum Resid 2 | 900+ | 0.9 | 1.8 |
| Average | | | 1.5 |
| API Gravity | Whole Crude | 0.26 | 0.51 |
| Viscosity at 40° C. | Whole Crude | 3.4% | 6.7% |

The following examples illustrate why API changes alone are insufficient to determine yield changes in a crude.

Example 2

In this example, two cargoes of same grade crude exhibit significant differences in API versus the most recent laboratory assay (differences of >0.5 numbers are considered to be outside laboratory reproducibility and therefore significant). The yield pattern was determined by Virtual Assay. In both cases the Virtual Assay was a Tier-1 fit and therefore statistically equivalent to a laboratory distillation.

Cargo 1 has increased by 0.9 numbers

Cargo 2 has increased by 1.4 numbers

The yields for the major boiling range cuts are shown below. Yield differences of >1.5% are considered to be outside laboratory reproducibility and therefore significant.

| Crude 1 | | | | | | | |
|---|---|---|---|---|---|---|---|
| | Measured CRUDE API Gravity | YIELDS Light Ends VPCT | YIELDS Naphtha VPCT | YIELDS Kero VPCT | YIELDS AGO VPCT | YIELDS VGO VPCT | YIELDS Resid VPCT |
| Laboratory/Assay | 28.9 | 0.90 | 21.15 | 14.18 | 16.19 | 27.40 | 20.18 |
| Cargo 1 | 29.8 | 1.18 | 24.34 | 14.02 | 14.64 | 25.39 | 20.43 |
| Cargo 2 | 30.3 | 1.28 | 25.16 | 14.29 | 14.90 | 24.94 | 19.44 |
| Delta 1 | −0.9 | −0.3 | −3.2 | 0.2 | 1.6 | 2.0 | −0.2 |
| Delta 2 | −1.4 | −0.4 | −4.0 | −0.1 | 1.3 | 2.5 | 0.7 |

As can be seen from the yields, there is no set pattern to changes that can be predicted from the API increase. Without the use of Virtual Assay these expected yields would remain undefined. Virtual Assay provides a basis for comparison with the yields from the unit, which would not be otherwise is possible.

Example 3

In this example, three cargoes of another crude were analyzed, each having a 0.6 API offset (statistically significant) versus the laboratory assay. A Virtual Assay was performed on each of the samples. As can be seen from the data, although the API has changed, the internal yield of the crude has not been altered in a statistically significant way. Without Virtual Assay, refinery personnel may have concluded that any actual yield deviation versus that predicted from the laboratory assay data was due to a change in the crude. Using Virtual Assay shows that this would likely be a false assumption.

| Crude 2 | | | | | | | |
|---|---|---|---|---|---|---|---|
| | | Measured CRUDE API Gravity | YIELDS Naphtha Volume % | YIELDS Kero Volume % | YIELDS AGO Volume % | YIELDS VGO Volume % | YIELDS Resid Volume % |
| Difference Virtual Assay (VA) measured in Refinery 1 (R1) or Refinery 2 (R2) versus laboratory assay | | | | | | | |
| Cargo 1 | R1 | 0.60 | 0.52 | 0.54 | 0.35 | −0.60 | −0.79 |
| Cargo 2 | R2 | 0.60 | 0.40 | 0.08 | −0.15 | 0.05 | −0.44 |
| Cargo 3 | R1 | 0.60 | 0.99 | −0.04 | −0.39 | −0.47 | −0.39 |

Example 4

This is a more extreme example where a significant volume of data was recorded for a highly variable crude. As can be seen from the data, this crude exhibits wide variations in API and the resulting yield changes also exhibit significant variation. Using VA, refinery personnel can track the expected yields from the crude unit and thereby monitor performance. In the absence of VA, it would be difficult to determine how much of the difference between actual performance and predicted are due to the changes in crude quality.

| Crude 3 | | | | | | | |
|---|---|---|---|---|---|---|---|
| | Measured CRUDE API Gravity | YIELDS Light Ends Volume % | YIELDS Naphtha Volume % | YIELDS Kero Volume % | YIELDS AGO Volume % | YIELDS VGO Volume % | YIELDS Resid Volume % |
| Difference Virtual Assay (VA) measured in Refinery 3 (R3) versus laboratory assay | | | | | | | |
| Cargo 1 | −4.0 | −0.7 | −5.3 | −0.2 | 1.2 | 2.1 | 2.9 |
| Cargo 2 | −3.5 | −0.7 | −5.8 | −0.1 | 0.8 | 2.8 | 2.9 |
| Cargo 3 | −2.6 | −0.6 | −3.7 | −0.5 | 0.7 | 1.8 | 2.2 |
| Cargo 4 | −3.4 | −0.8 | −4.4 | 0.0 | 0.8 | 1.5 | 2.9 |
| Cargo 5 | −2.8 | −0.6 | −3.9 | −0.4 | 0.7 | 1.9 | 2.3 |
| Cargo 6 | −3.3 | −0.8 | −4.7 | −0.5 | 0.7 | 2.3 | 3.0 |
| Cargo 7 | −2.9 | −0.6 | −4.8 | −0.5 | 0.7 | 2.2 | 2.3 |
| Cargo 8 | −2.9 | −0.8 | −4.3 | 0.4 | 1.0 | 1.3 | 2.5 |
| Cargo 9 | −2.1 | −0.6 | −3.3 | 0.4 | 0.7 | 0.8 | 2.0 |
| Cargo 10 | −3.0 | −0.8 | −4.2 | 0.1 | 0.9 | 1.3 | 2.6 |
| Cargo 11 | −3.5 | −0.8 | −4.5 | 0.0 | 0.8 | 1.5 | 3.0 |
| Cargo 12 | −2.6 | −0.7 | −3.7 | 0.3 | 0.8 | 1.0 | 2.3 |
| Cargo 13 | −2.4 | −0.7 | −3.3 | 0.3 | 0.6 | 0.7 | 2.3 |
| Cargo 14 | −2.3 | −0.7 | −3.3 | 0.0 | 0.7 | 1.0 | 2.3 |
| Cargo 15 | −2.2 | −0.6 | −3.1 | 0.4 | 0.7 | 0.6 | 2.0 |
| Cargo 16 | −2.9 | −0.7 | −3.9 | 0.0 | 0.9 | 1.2 | 2.5 |
| Cargo 17 | −3.3 | −0.9 | −4.6 | 0.1 | 1.0 | 1.5 | 2.9 |
| Cargo 18 | −3.5 | −0.7 | −4.5 | −0.1 | 0.6 | 1.6 | 3.1 |
| Cargo 19 | −3.4 | −0.8 | −4.8 | −0.6 | 0.7 | 2.5 | 3.0 |
| Cargo 20 | −3.6 | −1.0 | −5.0 | 0.1 | 1.0 | 1.8 | 3.0 |
| Cargo 21 | −2.8 | −0.8 | −4.1 | 0.4 | 0.9 | 1.1 | 2.4 |
| Cargo 22 | −2.9 | −0.7 | −4.0 | 0.1 | 0.8 | 1.3 | 2.5 |
| Cargo 23 | −3.0 | −0.8 | −3.7 | 0.1 | 0.8 | 1.2 | 2.4 |
| Cargo 24 | −2.0 | −0.6 | −2.7 | −0.1 | 0.6 | 1.3 | 1.4 |
| Cargo 25 | 3.7 | 0.6 | 5.5 | 1.2 | −0.9 | −3.7 | −2.7 |
| Cargo 26 | 2.8 | 0.3 | 3.6 | 1.2 | −0.4 | −2.8 | −1.9 |
| Cargo 27 | −0.8 | −0.2 | −0.9 | 0.0 | 0.2 | 0.7 | 0.1 |
| Cargo 28 | −0.5 | −0.3 | −1.0 | 0.7 | 0.4 | −0.4 | 0.6 |
| Cargo 29 | −0.5 | −0.2 | 0.1 | 0.5 | 0.1 | −0.9 | 0.4 |
| Cargo 30 | −0.6 | −0.3 | −1.3 | 0.4 | 0.3 | −0.2 | 1.0 |
| Cargo 31 | −2.4 | −0.5 | −3.7 | 0.0 | 0.9 | 1.0 | 2.2 |

Plant Utilization

The following are examples of how Virtual Assay information can be used in plants to monitor/troubleshoot operations:

A refinery experienced a shortfall in expected lube production while processing particular crude. Using Virtual Assay, they were able to determine that the crude had changed and that the lube yields were lower as a result of the crude and not from plant operation.

Another refinery experienced a reduction in naphtha yield from an atmospheric Pipestill. The pipestill feed was analyzed by Virtual Assay. The results confirmed that the feed was not significantly changed versus the laboratory assay, which prompted them to further investigate unit performance as the cause of the reduced production.

A third refinery experienced an unexpected increase in gas oil production off the pipestill. Using their Virtual Assay results and confirming these with Virtual Assay results from a fourth refinery, they determined that the crude was not significantly changed. This allowed them to convince the plant operations personnel that the cause for the elevated gas oil production was unit operation, and thereby allowed the problem to be rectified more quickly.

Work Process

Developing an accurate representation of crude unit feed using Virtual Assay can utilize quality measurements taken at different points in the crude handling process. A Virtual Assay may be performed on a crude sample:

- Taken upon initial discharge from a ship into the refinery.
- From a pipeline delivered batch into the refinery or outside storage tank
- From the refinery crude tank, which may contain a mix of crudes or heels from previous grades stored in the tank
- On the transfer line inlet to the crude unit How these measurements will be used in the work processes is determined by the complexity of the blend feeding the crude unit as well as plant configuration.

The quality of the virtual assay can vary and is conditional upon an internally generated measure of the quality of the result.

A Tier-1 fit result is statistically equivalent to a laboratory assay in the quality of the yield predictions and will be used by plant personnel in predicting crude unit performance.

Method 1—Crude Measurement from the Crude Unit Inlet Transfer Line

When the sample is from the crude unit inlet transfer line, the resulting virtual assay is deemed to represent the actual quality of the crude feeding the unit. The Virtual Assay information can then be used directly to compare with actual crude unit yields to determine whether the crude unit is operating within the defined optimal operating envelope. Any deviation between the predicted operation and observed operation can be explained by a difference in operations and not as an unknown deviation in actual versus predicted crude quality.

Method 2—Crude Measurement from a Tank

The Virtual Assay from a crude sample that is taken from a tank can be used directly if:

A) The tank is deemed to be well mixed and the sample is representative of the entire tank mixture, or B) An all-levels tank sample is taken following the procedure of ASTM D4057.

Once the tank quality is determined using Virtual Assay, the resultant yields and qualities can be used to determine whether the crude unit is operating within the defined optimal operating envelope similar to Method 1.

Method 3—Crude Measurement from a Blend of Tanks

The steps considered in Method 2 are only valid if the crude unit is fed from a single tank. If two or more tanks are used to feed the crude unit then the resulting blend of crudes from those tanks must be determined. This can be done from a volumetric calculation using the tank compositions calculated by Virtual Assay in Method 2.

The steps of these three methods include feeding crude oil into the pipestill wherein the crude oil is separated into boiling range fractions, performing a virtual assay of the crude oil to determine predicted boiling range fractions, comparing the predicted boiling range fractions with the separated boiling range fractions to determine a difference between the two fractions and correlating the difference with operation of the pipestill. The operation of the pipestill can then be corrected to bring the output of the pipestill into agreement with the predicted output.

For simplicity, the difference between the predicted and measured yields will typically be considered significant if they exceed the estimated reproducibility of the wet assay distillation, 1.5%. However, for more detailed evaluation of the pipestill performance, the difference between predicted and measured yields for a specific cut can be compared to the prediction uncertainty (t×SEC in Table 1) for that cut, or to Confidence Intervals for each yield prediction calculated according to procedures described in Appendix 1.

Crude Unit process monitoring compares actual yields and key qualities with those that are predicted using the refinery ORM model, scheduling application or assay delivery tool. Deviations are then investigated to determine whether they are due to actual unit operation not being properly configured, equipment problems, or simply due to feed quality that is different than expected.

APPENDIX 1

In a preferred embodiment of U.S. Pat. No. 6,662,116 B2, FT-IR spectra are used in combination with API gravity and viscosity to predict assay data for crude oils. The FT-IR spectra of the unknown crude is augmented with the inspection data, and fit as a linear combination of augmented FT-IR spectra for reference crudes. This preferred embodiment of U.S. Pat. No. 6,662,116 B2 can be expressed mathematically as [1].

$$\min\left(\left(\begin{bmatrix}\hat{x}_u\\ w_{API}\hat{\lambda}_{u(API)}\\ w_{Visc}\hat{\lambda}_{u(Visc)}\end{bmatrix}-\begin{bmatrix}x_u\\ w_{API}\lambda_{u(API)}\\ w_{Visc}\lambda_{u(Visc)}\end{bmatrix}\right)^T\left(\begin{bmatrix}\hat{x}_u\\ w_{API}\hat{\lambda}_{u(API)}\\ w_{Visc}\hat{\lambda}_{u(Visc)}\end{bmatrix}-\begin{bmatrix}x_u\\ w_{API}\lambda_{u(API)}\\ w_{Visc}\lambda_{u(Visc)}\end{bmatrix}\right)\right) \quad [1a]$$

$$\text{where } \hat{x}_u = Xc_u,\ \hat{\lambda}_u(API) = \Lambda(API)c_u, \text{ and } \hat{\lambda}_u(visc) = \Lambda(visc)c_u \quad [1b]$$

$x_u$ is a column vector containing the FT-IR for the unknown crude, and X is the matrix of FT-IR spectra of the reference crudes. The FT-IR spectra are measured on a constant volume of crude oil, so they are blended on a volumetric basis. Both $x_u$ and X may have been orthogonalized to corrections as described in U.S. Pat. No. 6,662,116 B2. $x_u$ is augmented by adding two additional elements to the bottom of the column, $w_{API}\lambda_u$(API), and $w_{visc}\lambda_u$(visc). $\lambda_u$(api) and $\lambda_u$(visc) are the volumetrically blendable versions of the API gravity and viscosity inspections for the unknown, and Λ(API) and Λ(visc) are the corresponding volumetrically blendable inspections for the reference crudes. $w_{API}$ and $w_{visc}$ are the weighting factors for the two inspections. The $\hat{x}_u$ and $\hat{\lambda}_u$ values are the estimates of the spectrum and inspections based on the calculated linear combination with coefficients $c_u$. The linear combination is preferably calculated using a nonnegative least squares algorithm.

In U.S. Pat. No. 6,662,116 B2, the viscosity data used in calculating $\lambda_u$(visc) and Λ(visc) must be measured at the same temperature, and are converted to a Viscosity Blending Number using the relationship $$VBN=a+b\log(\log(v+c)) \quad [2]$$

For viscosities above 1.5 cSt, the parameter c is in the range of 0.6 to 0.8. For viscosities less than 1.5, c is typically expressed as a function of viscosity. A suitable function for c is given by:

$$c=0.098865v^4-0.49915v^3+0.99067v^2-0.96318v+0.99988 \quad [3]$$

For the purpose of U.S. Pat. No. 6,662,116 B2 and this invention, the parameter a is set to 0 and the parameter b is set to 1. If viscosities are assumed to blend on a weight basis, the VBN calculated from [13] would be multiplied by the specific gravity of the material to obtain a volumetrically blendable number. The method used to obtain volumetrically blendable numbers would typically be chosen to match that used by the program that manipulates the data from the detailed analysis to produce assay predictions.

If viscosity data for the reference crudes is not available at the temperature for which the viscosity is measured for the unknown, then equation [1] cannot be directly applied.

For crude oils, ASTM D341 (see Annual Book of ASTM Standards, Volumes 5.01-5.03, American Society for Testing and Materials, Philadelphia, Pa.) describes the temperature dependence of viscosity. An alternate way of expressing this relationship is given by [4].

$$VBN(T)=\log(\log(\nu(T)+c))=A+B\log T \quad [4]$$

T is the absolute temperature in ° C. or ° R. The parameters A and B are calculated based on fitting [4] for viscosities measured at two or more temperatures.

If the viscosity of the unknown is not measured at a temperature for which viscosity data was measured for the reference crudes, then two alternatives can be applied. First, equation [4] can be applied to the viscosity data for the reference crudes to calculate $v_{references}$ at the temperature at which the unknown's viscosity was measured. The calculated viscosities for the references are then used to calculate Λ(visc), and equation [1] is applied. Alternatively, the slope, B, in [2] can be estimated based on the analysis of the FT-IR spectrum, or the FT-IR spectrum and API Gravity, and B can be used in combination with the measured viscosity to estimate a viscosity of the unknown at a common reference temperature.

The following algorithmic method has been found to offer advantages for the analysis on unknowns:

Step 1:

In step 1, no inspection data is used.

$$\min((\hat{x}_u-x_u)^T(\hat{x}_u-x_u)) \quad [5]$$

where $\hat{x}_u=Xc_{step1}$

Equation [4] is applied to nonaugmented spectral data to calculate a linear combination that matches the FT-IR spectrum of the unknown. A non-negative least squares algorithm is preferably used to calculate the coefficients $c_{step1}$. The sum of the coefficients is calculated, and a scaling factor, s, is calculated as the reciprocal of the sum. The coefficients are scaled by the scaling factor. The unknown spectrum is also scaled by the scaling factor. An $R^2$ value is calculated using [6].

$$R^2_{step1} = 1 - \frac{(\hat{x}_u - sx_u)^T(\hat{x}_u - sx_u)/(f-c-1)}{(sx_u - \overline{sx}_u)^T(sx_u - \overline{sx}_u)/(f-1)} \quad [6]$$

f is the number of points in the spectra vector $x_u$, and c is the number of non-zero coefficients from the fit. Other goodness-of-fit statistics could be used in place of $R^2$.

Step 2:

In step 2, the scaled spectrum from step 1 is augmented with the volumetrically blendable version of the API gravity data (i.e. specific gravity) to form vector $$\begin{bmatrix} sx_u \\ w_{API}\lambda_{u(API)} \end{bmatrix}.$$

An estimate of the augmented vector, $$\begin{bmatrix} \hat{x}_u \\ w_{API}\hat{\lambda}_{u(API)} \end{bmatrix},$$

is calculated from the coefficients from step 1, and the relationships in equation [1b]. An initial $R^2$ value is calculated using [7].

$$R^2_{step2} = 1 - \frac{\left(\begin{bmatrix} \hat{x}_u \\ w_{API}\hat{\lambda}_{u(API)} \end{bmatrix} - \begin{bmatrix} sx_u \\ w_{API}\lambda_{u(API)} \end{bmatrix}\right)^T \left(\begin{bmatrix} \hat{x}_u \\ w_{API}\hat{\lambda}_{u(API)} \end{bmatrix} - \begin{bmatrix} sx_u \\ w_{API}\lambda_{u(API)} \end{bmatrix}\right) \Big/ (f+1-c-1)}{\left(\begin{bmatrix} sx_u \\ w_{API}\lambda_{u(API)} \end{bmatrix} - \overline{\begin{bmatrix} sx_u \\ w_{API}\lambda_{u(API)} \end{bmatrix}}\right)^T \left(\begin{bmatrix} sx_u \\ w_{API}\lambda_{u(API)} \end{bmatrix} - \overline{\begin{bmatrix} sx_u \\ w_{API}\lambda_{u(API)} \end{bmatrix}}\right) \Big/ (f+1-1)} \quad [7]$$

$$\overline{\begin{bmatrix} sx_u \\ w_{API}\lambda_{u(API)} \end{bmatrix}}$$

is a vector of the same length as vector $$\begin{bmatrix} sx_u \\ w_{API}\lambda_{u(API)} \end{bmatrix},$$

all of whose elements are the average of the elements in the vector $$\begin{bmatrix} sx_u \\ w_{API}\lambda_u(API) \end{bmatrix}.$$

The scaled, augmented spectral vector is then fit using $$\min\left(\left(\begin{bmatrix} \hat{x}_u \\ w_{API}\hat{\lambda}_u(API) \end{bmatrix} - \begin{bmatrix} sx_u \\ w_{API}\lambda_u(API) \end{bmatrix}\right)^T \left(\begin{bmatrix} \hat{x}_u \\ w_{API}\hat{\lambda}_u(API) \end{bmatrix} - \begin{bmatrix} sx_u \\ w_{API}\lambda_u(API) \end{bmatrix}\right)\right) \quad [8a]$$

where $\hat{x}_u = Xc_{step2}$, and $\hat{\lambda}_u(API) = \Lambda_{(API)}c_{step2}$ [8b]

The coefficients, $c_{step2}$ calculated from the preferably non-negative least squares fit are summed, and a new scaling factor, s, is calculated as the reciprocal of the sum times the previous scaling factor. The coefficients are scaled to sum to unity, and the estimate, $$\begin{bmatrix} \hat{x}_u \\ w_{API}\hat{\lambda}_u(API) \end{bmatrix},$$

of the augmented spectral vector is recalculated based on these normalized coefficients and [8b]. An $R^2$ value is again calculated using [7] and the new scaling factor. If the new $R^2$ value is greater than the previous value, the new fit is accepted. Equations [8] are again applied using the newly calculated scaling factor. The process continues until no further increase in the calculated $R^2$ value is obtained.

Step 3 Using Viscosity Blending Numbers

If a viscosity blending number based on viscosity measured at a single fixed temperature is to be used, then in step 3, the scaled, augmented spectral vector from step 2 that gave the best $R^2$ value is further augmented with the volumetrically blendable version of the viscosity data to form vector $$\begin{bmatrix} sx_u \\ w_{API}\lambda_u(API) \\ w_{Visc}\lambda_u(Visc) \end{bmatrix}.$$

Estimates of the augmented vector, $$\begin{bmatrix} \hat{x}_u \\ w_{API}\hat{\lambda}_u(API) \\ w_{Visc}\hat{\lambda}_u(Visc) \end{bmatrix},$$

are calculated using the $c_{step2}$, and the relationships in equation [1b]. An initial $R^2$ value is calculated using [9].

$$R^2_{step3} = 1 - \frac{\left(\begin{bmatrix} \hat{x}_u \\ w_{API}\hat{\lambda}_u(API) \\ w_{Visc}\hat{\lambda}_u(Visc) \end{bmatrix} - \begin{bmatrix} sx_u \\ w_{API}\lambda_u(API) \\ w_{Visc}\lambda_u(Visc) \end{bmatrix}\right)^T \left(\begin{bmatrix} \hat{x}_u \\ w_{API}\hat{\lambda}_u(API) \\ w_{Visc}\hat{\lambda}_u(Visc) \end{bmatrix} - \begin{bmatrix} sx_u \\ w_{API}\lambda_u(API) \\ w_{Visc}\lambda_u(Visc) \end{bmatrix}\right) \Big/ (f+2-c-1)}{\left(\begin{bmatrix} sx_u \\ w_{API}\lambda_u(API) \\ w_{Visc}\lambda_u(Visc) \end{bmatrix} - \overline{\begin{bmatrix} sx_u \\ w_{API}\lambda_u(API) \\ w_{Visc}\lambda_u(Visc) \end{bmatrix}}\right)^T \left(\begin{bmatrix} sx_u \\ w_{API}\lambda_u(API) \\ w_{Visc}\lambda_u(Visc) \end{bmatrix} - \overline{\begin{bmatrix} sx_u \\ w_{API}\lambda_u(API) \\ w_{Visc}\lambda_u(Visc) \end{bmatrix}}\right) \Big/ (f+2-1)} \quad [9]$$

$$\overline{\begin{bmatrix} sx_u \\ w_{API}\lambda_u(API) \\ w_{Visc}\lambda_u(Visc) \end{bmatrix}}$$

is a vector of the same length as $$\begin{bmatrix} sx_u \\ w_{API}\lambda_u(API) \\ w_{Visc}\lambda_u(Visc) \end{bmatrix},$$

whose elements are the average of the elements in $$\begin{bmatrix} sx_u \\ w_{API}\lambda_u(API) \\ w_{Visc}\lambda_u(Visc) \end{bmatrix}.$$

The scaled, augmented spectral vector is then fit using $$\min\left(\left(\begin{bmatrix} \hat{x}_u \\ w_{API}\hat{\lambda}_u(API) \\ w_{Visc}\hat{\lambda}_u(Visc) \end{bmatrix} - \begin{bmatrix} sx_u \\ w_{API}\lambda_u(API) \\ w_{Visc}\lambda_u(Visc) \end{bmatrix}\right)^T \left(\begin{bmatrix} \hat{x}_u \\ w_{API}\hat{\lambda}_u(API) \\ w_{Visc}\hat{\lambda}_u(Visc) \end{bmatrix} - \begin{bmatrix} sx_u \\ w_{API}\lambda_u(API) \\ w_{Visc}\lambda_u(Visc) \end{bmatrix}\right)\right) \quad [10a]$$

$$\text{where } \hat{x}_u = Xc_{step3},\ \hat{\lambda}_u(API) = \Lambda_{(API)}c_{step3}, \text{ and } \hat{\lambda}_u(visc) = \Lambda_{(visc)}c_u \quad [10b]$$

The coefficients, $c_{step3}$ calculated from the preferably non-negative least squares fit are summed, and a new scaling factor, s, is calculated as the reciprocal of the sum times the previous scaling factor. The coefficients are scaled to sum to unity, and the estimate, $$\begin{bmatrix} \hat{x}_u \\ w_{API}\hat{\lambda}_u(API) \\ w_{Visc}\hat{\lambda}_u(Visc) \end{bmatrix},$$

of the augmented spectral vector is recalculated based on these normalized coefficients and [10b]. An $R^2$ value is again calculated using [9] and the new scaling factor. If the new $R^2$ value is greater than the previous value, the new fit is accepted. Equations [10a] and [10b] are again applied using the newly calculated scaling factor. The process continues until no further increase in the calculated $R^2$ value is obtained. A "virtual blend" of the reference crudes is calculated based on the final $c_{step3}$ coefficients, and assay properties are predicted using known blending relationships as described in U.S. Pat. No. 6,662,116 B2.

Step 2 if API Gravity is Unavailable:

If API gravity is unavailable, in step 2, the scaled spectrum from step 1 is augmented with the volumetrically blendable version of the viscosity data to form vector $$\begin{bmatrix} sx_u \\ w_{Visc}\lambda_u(Visc) \end{bmatrix}.$$

An estimate of the augmented vector, $$\begin{bmatrix} \hat{x}_{u8} \\ w_{Visc}\hat{\lambda}_u(Visc) \end{bmatrix},$$

is calculated from the coefficients from step 1, and the relationships in equation [1b]. An initial $R^2$ value is calculated using [11].

$$R^2 = 1 - \frac{\left(\begin{bmatrix} \hat{x}_u \\ w_{Visc}\hat{\lambda}_u(Visc) \end{bmatrix} - \begin{bmatrix} sx_u \\ w_{Visc}\lambda_u(Visc) \end{bmatrix}\right)^T \left(\begin{bmatrix} \hat{x}_u \\ w_{Visc}\hat{\lambda}_u(Visc) \end{bmatrix} - \begin{bmatrix} sx_u \\ w_{Visc}\lambda_u(Visc) \end{bmatrix}\right) \Big/ (f+1-c-1)}{\left(\begin{bmatrix} sx_u \\ w_{Visc}\lambda_u(Visc) \end{bmatrix} - \begin{bmatrix} sx_u \\ w_{Visc}\lambda_u(Visc) \end{bmatrix}\right)^T \left(\begin{bmatrix} sx_u \\ w_{Visc}\lambda_u(Visc) \end{bmatrix} - \begin{bmatrix} sx_u \\ w_{Visc}\lambda_u(Visc) \end{bmatrix}\right) \Big/ (f+1-1)} \quad [11]$$

$$\overline{\begin{bmatrix} sx_u \\ w_{Visc}\lambda_u(Visc) \end{bmatrix}}$$

is a vector of the same length as $$\begin{bmatrix} sx_u \\ w_{Visc}\lambda_u(Visc) \end{bmatrix},$$

whose elements are the average of the elements in $$\begin{bmatrix} sx_u \\ w_{Visc}\lambda_u(Visc) \end{bmatrix}.$$

The scaled, augmented spectral vector is then fit using $$\min\left(\left(\begin{bmatrix} \hat{x}_u \\ w_{Visc}\hat{\lambda}_u(Visc) \end{bmatrix} - \begin{bmatrix} sx_u \\ w_{Visc}\lambda_u(Visc) \end{bmatrix}\right)^T \left(\begin{bmatrix} \hat{x}_u \\ w_{Visc}\hat{\lambda}_u(Visc) \end{bmatrix} - \begin{bmatrix} sx_u \\ w_{Visc}\lambda_u(Visc) \end{bmatrix}\right)\right) \quad [12]$$

where $\hat{x}_u = Xc_{step2}$, and $\hat{\lambda}_u(Visc) = \Lambda(Visc)c_{step2}$ The coefficients, $c_{step2}$ calculated from the preferably non-negative least squares fit are summed, and a new scaling factor, s, is calculated as the reciprocal of the sum times the previous scaling factor. The coefficients are scaled to sum to unity, and the estimate, $$\begin{bmatrix} \hat{x}_{u8} \\ w_{Visc}\hat{\lambda}_u(Visc) \end{bmatrix},$$

of the augmented spectral vector is recalculated based on these normalized coefficients and [12b]. An $R^2$ value is again calculated using [11] and the new scaling factor. If the new $R^2$ value is greater than the previous value, the new fit is accepted. Equations [12a] and [12b] are again applied using the newly calculated scaling factor. The process continues until no further increase in the calculated $R^2$ value is obtained. A "virtual blend" of the reference crudes is calculated based on the final $c_{step2}$ coefficients, and assay properties are predicted using known blending relationships as described in U.S. Pat. No. 6,662,116 B2.

Step 3 Alternative:

In step 3 above, viscosity data for the references must be known or calculable at the temperature at which the viscosity for the unknown is measured. Alternatively, the viscosity/temperature slop, B, can be estimated and used to calculate the viscosity at a fixed temperature for which viscosity data for reference crudes is known.

The viscosity/temperature slope for the unknown, $\hat{B}_u$, is estimated as the blend of the viscosity/temperature slopes of the reference crudes using the coefficients $c_{step2}$ from step 2. If the slopes are blended on a weight basis, the $c_{step2}$ coefficients are converted to their corresponding weight percentages using the specific gravities of the references. The estimated slope, $\hat{B}_u$, the viscosity for the unknown, $v_u$, and the temperature at which the viscosity was measured, $T_u$ are used to calculate the viscosity, $v_u(T_f)$ at a fixed temperature $T_f$ using relationship [13].

$$\log(\log(v_u(T_f)+c)) = \log(\log(v_u+c)) + B\log\left(\frac{T_f}{T_u}\right) \quad [13]$$

The $v_u(T_f)$ value is used to calculate a volumetrically blendable viscosity value, $\lambda_u$, for use in $$\begin{bmatrix} sx_u \\ w_{API}\lambda_u(API) \\ w_{Visc}\lambda_u(Visc) \end{bmatrix}.$$

Each time new coefficients $c_{step3}$ are calculated, the slope $\hat{B}_u$ is reestimated based on the new blend and used to calculate new values of $V_u(T_1)$ and $\lambda_u$ for use in calculating a new $R^2$ via equation [9].

Step 2 Alternative if API Gravity is Unavailable:

If API gravity is unavailable, the procedure described above under Step 3 Alternative is applied using the coefficients $c_{step1}$ to estimate the viscosity/temperature slope in the calculation of $v_u(T_f)$.

Incorporation of Additional Inspection Data:

Other inspections in addition to API gravity and viscosity can lo optionally be used in the calculation. The volumetrically blendable form of the data for these inspections are included in the augmented vector in Step 2 along with the viscosity data to form an augmented vector $$\begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix}.$$

The calculations then proceed as described above. At each step in the calculations, the predictions of the additional inspections are given by [14].

$$\hat{\lambda}_u(\text{inspection})=\Lambda(\text{inspection})c \quad [14]$$

Other inspections that might be included include, but are not limited to, sulfur, nitrogen, and acid number. The value of $R^2$ would be calculated as:

$$R^2_{step3} = 1 - \frac{\left(\begin{bmatrix} \hat{x}_u \\ w_{API}\hat{\lambda}_u(API) \\ w_{Inspection1}\hat{\lambda}_u(Inspection1) \\ \vdots \\ w_{InspectionLast}\hat{\lambda}_u(InspectionLast) \end{bmatrix} - \begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix}\right)^T \left(\begin{bmatrix} \hat{x}_u \\ w_{API}\hat{\lambda}_u(API) \\ w_{Inspection1}\hat{\lambda}_u(Inspection1) \\ \vdots \\ w_{InspectionLast}\hat{\lambda}_u(InspectionLast) \end{bmatrix} - \begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix}\right)}{(f+i-c-1)}$$
$$\frac{\left(\begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix} - \overline{\begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix}}\right)^T \left(\begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix} - \overline{\begin{bmatrix} sx_u \\ w_{API}\lambda_u(API) \\ w_{Inspection1}\lambda_u(Inspection1) \\ \vdots \\ w_{InspectionLast}\lambda_u(InspectionLast) \end{bmatrix}}\right)}{(f+i-1)} \quad [15]$$

i is the number of inspections used.

Volumentrically Blendable Viscosity

The volumetrically blendable version of API gravity is specific gravity. If API gravity is used as input into the current invention, it is converted to specific gravity prior to use. Viscosity data is also converted to a volumetrically blendable form.

U.S. Pat. No. 6,662,116 B2 describes several methods that can be used to convert viscosity to a blendable form. The current invention also provides for the use of a Viscosity Blending Index (VBI. The VBI is based on the viscosity at 210° F. For reference crudes, the viscosity at 210° F. is calculated based on viscosities measured at two or more temperatures and the application of equations [4] and [13]. For unknowns, the $T_f$ value used in the alternative step 3 is chosen as 210° F. The Viscosity Blending Index is related to the viscosity at 210° F. by equation [14].

$$\nu_{210^\circ F} = \exp(0.0000866407 \cdot VBI^6 - 0.00422424 \cdot VBI^5 + .0671814 \cdot VBI^4 - 0.541037 \cdot VBI^3 + 2.65449 \cdot VBI^2 + 8.95171 \cdot VBI + 16.80023) \quad [16]$$

The VBI value corresponding to a given viscosity can be found from [10] using standard scalar nonlinear function minimization routines such as the fminbnd function in MATLAB® (Mathworks, Inc.).

Weighting of Inspection Data:

The inspection data used in steps 2 and 3 in the above algorithms is weighted as described in U.S. Pat. No. 6,662,116 B2. Specifically, the weight, w, has the form [17].

$$w = \frac{2.77 \cdot \alpha \cdot \varepsilon}{R} \quad [17]$$

R is the reproducibility of the inspection data calculated at the level for the unknown being analyzed. $\epsilon$ is the average per point variance of the corrected reference spectra in X. For crude spectra collected in a 0.2-0.25 mm cell, $\epsilon$ can be assumed to be 0.005. $\alpha$ is an adjustable parameter. $\alpha$ is chosen to obtain the desired error distribution for the prediction of the inspection data from steps 2 and 3.

Since the magnitude of the viscosity data changes with temperature, its contribution to the fit in steps 3 or alternative step 2 will also change. Thus the adjustable parameter for the weighting must be adjusted to obtain comparable results when using viscosity data at different temperatures. Because of interactions between the inspection data when more than one inspection is included in a fit, all of the weightings will depend on the viscosity measurement temperature, T.

$$w(T) = \frac{2.77 \cdot \alpha(T) \cdot \varepsilon}{R} \quad [18]$$

The values of $\alpha$ are determined at each viscosity measurement temperature using a cross-validation analysis where each reference crude is taken out of X and treated as an unknown, $x_u$.

Prediction Quality

Predictions made using different inspection inputs, or different sets of references will differ. Inspection data is included in the analysis only if it improves the prediction of some assay data. However, it is useful to be able to compare the quality of predictions made using different inspection inputs, and/or different sets of references. For laboratory application, such comparisons can be used as a check on the quality of the inspection data. For online application, analyzers used to generate inspection data may be temporarily unavailable do to failure or maintenance, and it is desirable to know how the absence of the inspection data influences the quality of the predictions.

For the purpose of comparing predictions made using different subsets of inspection data, it is preferable to have a single quality parameter that represents the overall quality of the predicted data. Given the large number of assay properties that can be predicted, it is impractical to represent the quality of all possible predictions. However, for a set of key properties, a single quality parameter can be defined.

The Fit Quality (FQ) is defined by [19].

$$FQ=f(c,f,i)\sqrt{1-R^2} \quad [19]$$

f(c, f, i) is a function of the number on nonzero coefficients in the fit, c, the number of spectral points, f, and the number of inspections used, i. For the application of this invention to the prediction of crude assay data, an adequate funtion has been found to be of the form $$FQ=c^{e}\sqrt{1-R^2} \quad [20]$$

Thee exponent is preferably on the order of 0.25. FQ is calculated from the $R^2$ value at each step in the calculation. A Fit Quality Cutoff ($FQC_{IR}$) is defined for the results from Step 1 of the calculations, i.e. for the analysis based on only the FT-IR spectra. The $FQC_{IR}$ is selected based on some minimum performance criteria. A Fit Quality Ratio is then defined by [16].

$$FQR_{IR}=\frac{FQ}{FQC_{IR}} \quad [21]$$

For steps 2 and 3 in the algorithm, $FQC_{IR,API}$ and $FQC_{IR,API,Visc}$. cutoffs are also defined. These cutoffs are determined by an optimization procedure designed to match as closely as possible the accuracy of predictions made using the different inputs. The cutoffs are used to define $FQR_{IR,API}$ and $FQR_{IR,API,Visc}$.

These FQR values are the desired quality parameters that allows analyses made using different inspection inputs and different reference subsets to be compared. Generally, analyses that produce lower FQR values can be expected to produce generally more accurate predictions. Similarly, two analyses made using different inspection inputs or different reference subsets that produce fits of the same FQR are expected to produce assay predictions of similar accuracy.

The values of $FQC_{IR,API}$ and $FQC_{IR,API,Visc}$ are also set based on performance criteria. A critical set of assay properties is selected. For the assay predictions from step 2 (FT-IR and API Gravity) and step 3 (FT-IR, API Gravity and viscosity), the FQC value is selected such that the predictions for samples with FQR values less than or equal to 1 will be comparable to those obtained from step 1 (FT-IR only). The weightings for inspections are simultaneously adjusted such that the prediction errors for the inspections match the expected errors for their test methods. The FQC values and inspection weightings can be adjusted using standard optimization procedures.

Analyses that produce FQR values less than or equal to 1 are referred to as Tier 1 fits. Analyses that produce FQR values greater than 1, but less than or equal to 1.5 are referred to as Tier 2 fits.

Confidence Intervals:

In determining if a particular assay prediction is adequate for use in a process application, it is useful to provide an estimate of the uncertainty on the prediction. The Confidence Interval expresses the expected agreement between a predicted property for the unknown, and the value that would be obtained if the unknown were subjected to the reference analysis. The confidence intervals for each property is estimated as a function of FQR.

The general form for the confidence interval is:

$$CI=t\cdot s\cdot\sqrt{FQR^2+f(E_{ref})^2} \quad [22]$$

$f(E_{ref})$ is a function of the error in the reference property measurement. t is the t-statistic for the selected probability level and the number of degrees of freedom in the CI calculation. s is the standard deviation of the prediction residuals once the FQR and reference property error dependence is removed.

For application of this invention to the prediction of crude assay data, the following forms of the confidence interval have been found to provide useful estimates of prediction error:

Absolute Error $CI$: [23]

$$|\hat{y}-y|\le CI_{abs}=t\cdot s\cdot\sqrt{FQR^2+\left(a+b\left(\frac{\hat{y}+y}{2}\right)\right)^2}$$

Relative Error $CI$: [24]

$$\left|\frac{\hat{y}-y}{(\hat{y}+y)/2}\right|\le CI_{rel}=t\cdot s\cdot\sqrt{FQR^2+a^2}$$

a and b are parameters that are calculated to fit the error distributions obtained during a cross-validation analysis of the reference data. y is a measured assay property, and $\hat{y}$ is the corresponding predicted property. Which CI is applied depends on the error characteristics of the reference method. For property data where the reference method error is expected to be independent of property level, Absolute Error CI is used, and parameter b is zero. For property data where the reference method error is expected to be directly proportional to the property level, Relative Error CI is used. For property data where the reference method error is expected to depend on, but not be directly proportional to the property level, Absolute Error CI is used and both a and b can be nonzero.

For inspection data that is included in the fit, the Confidence Intervals take a slightly different form.

Absolute Error $CI$ for inspections: [25]

$$|\hat{y}-y|\le CI_{abs}=t\cdot s\cdot\sqrt{1-R^2}$$

Relative Error $CI$ for inspections: [26]

$$\left|\frac{\hat{y}-y}{(\hat{y}+y)/2}\right|\le CI_{rel}=t\cdot s\cdot\sqrt{1-R^2}$$

Equation [25] applies to inspections such as API Gravity where the reference method error is independent of the property level. Equation [26] applies to inspections such as viscosity where the reference method error is directly proportional to the property level.

Analyses Using Reference Subsets:

When the current invention is applied to the analysis of crude oils for the prediction of crude assay data, it is desirable to limit the references used in the analysis to crudes that are most similar to the unknown being analyzed, providing that the quality of the resultant fit and predictions are adequate. Subsets of various sizes can be tested based on their similarity to the unknown. For crude oils, the following subset definitions have been found to be useful:

| Subset | Includes |
|---|---|
| Specific Reference(s) | User selected references |
| Same Grade(s) | References of the same grade(s) as the unknown |
| Same Location(s) | References from the same general geographic location(s) (country or state) as the unknown |
| Same Region(s) | References from the same general geographic region(s) as the unknown |
| All Crudes | All crude references in the library |

If, during the analysis of an unknown crude, a Tier 1 fit is obtained using a smaller subset, then the following advantages are realized:

The Virtual Blend produced by the analysis will have fewer components, simplifying and speeding the calculation of the assay property data;

The assay predictions for trace level components which are not directly sensed by the multivariate analytical or inspection measurements may be improved;

The analysis is based on a Virtual Blend of crudes with which the end user (the refiner) may be more familiar.

Subsets could also be based on geochemical information instead of geographical information. For application to process streams, subsets could be based on the process history of the samples.

If the sample being analyzed is a mixture, the subsets may consist of samples of the grades, locations and regions as the expected crude components in the mixture.

Contaminants:

The references used in the analysis can include common contaminants that may be observed in the samples being analyzed. Typically, such contaminants are materials that are not normally expected to be present in the unknown, which are detectable and identifiable by the multivariate analytical measurement. Acetone is an example of a contaminant that is observed in the FT-IR spectra of some crude oils, presumably due to contamination of the crude sampling container.

Reference spectra for the contaminants are typically generated by difference. A crude sample is purposely contaminated. The spectrum of the uncontaminated crude is subtracted from the spectrum of the purposely-contaminated sample to generate the spectrum of the contaminant. The difference spectrum is then scaled to represent the pure material. For example, if the contaminant is added at 0.1%, the difference spectrum will be scaled by 1000.

Contaminants are tested as references in the analysis only when Tier 1 fits are not obtained using only crudes as references. If the inclusion of contaminants as references produces a Tier 1 fit when a Tier 1 fit was not obtained without the contaminant, then the sample is assumed to be contaminated.

Inspection data is calculated for the Virtual Blend including and excluding the contaminant. If the change in the calculated inspection data is greater than one half of the reproducibility of the inspection measurement method, then the sample is considered to be too contaminated to accurately analyze. If the change in the calculated inspection data is less than one half of the reproducibility of the inspection measurement method, then the assay results based on the Virtual Blend without the contaminant are assumed to be an accurate representation of the sample.

Alternatively, a maximum allowable contamination level can be set based on the above criteria for a typical crude sample. If the calculated contamination level exceeds this maximum allowable level, then the samples is considered to be too contaminated to accurately analyze. For acetone in crudes, a maximum allowable contamination level of 0.25% level can be used based an estimated 4-5% change in viscosity for medium API crudes.

For each contaminant used as a reference, a maximum allowable level is set. If the calculated level of the contaminant is less than the allowable level, assay predictions can still be made, and uncertainties estimated based on the Fit Quality Ratio. Above this maximum allowable level, assay predictions may be less accurate due to the presence of the contaminant.

If multiple contaminants are used as references, a maximum combined level may be set. If the combined contamination level is less than the maximum combined level, assay predictions can still be made, and uncertainties estimated based on the Fit Quality Ratio. Above this maximum combined level, assay predictions may be less accurate due to the presence of the contaminants.

Analysis Scheme:

If the function f(c,f,i) in [19] is close to unity (e.g. the value of $\epsilon$ in [20] is close to zero), then FQ will tend to decrease as more components are added to the blend, and analyses done with larger subsets of references will tend to produce lower FQ values. In this case, for the application of this invention to the prediction of crude assay data, the "First Tier 1 Fit" scheme depicted in FIG. 1 has been found to yield reasonable prediction quality. For simplicity only analyses based on FT-IR only, FT-IR and API, or FT-IR, API and viscosity are shown. If analyses for FT-IR and viscosity were also used, a separate column would be added to the scheme in the figure.

Assuming that the API Gravity and viscosity for the unknown have been measured, the analysis scheme starts at point 1. The user may supply a specific set of references to be used in the analysis. Fits are conducted according to the three steps described herein above. Although an FT-IR only based fit (step 1) and an FT-IR & API based fit (step 2) are calculated, they are not evaluated at this point. If the fit based on FT-IR, API Gravity and viscosity produces a Tier 1 fit, the analysis is complete and the results are reported.

If the analysis at point 1 does not produce a Tier 1 fit, then the process proceeds to point 2. The reference set is expanded to include all references that are of the same crude grade(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 2 does not produce a Tier 1 fit, then the process proceeds to point 3. The reference set is expanded to include all references that are from the same location(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 3 does not produce a Tier 1 fit, then the process proceeds to point 4. The reference set is expanded to include all references that are from the same region(s) as the initially selected crudes. The three-step analysis is again conducted, and the analysis based on FT-IR, API Gravity and viscosity is examined. If this analysis produces a Tier 1 fit, the analysis is complete and the results are reported.

If the analysis at point 4 does not produce a Tier 1 fit, then the process proceeds to point 5. The reference set is expanded to include all references crudes. The three-step analysis is again conducted, and the analysis based on FT-IR, API Gravity and viscosity is examined. If this analysis produces a Tier 1 fit, the analysis is complete and the results are reported.

If the analysis at point 5 does not produce a Tier 1 fit, then the process proceeds to point 6. The reference set is expanded to include all references crudes and contaminants. The three-step analysis is again conducted, and the analysis based on FT-IR, API Gravity and viscosity is examined. If this analysis produces a Tier 1 fit, the analysis is complete and the results are reported, and the sample is reported as being contaminated. If the contamination does not exceed the maximum allowable level, assay results may still be calculated and Confidence Intervals estimated based on the fit FQR. If the contamination does exceed the allowable level, the results may be less accurate than indicated by the FQR.

If the analysis at point 6 does not produce a Tier 1 fit, then the fits based on FT-IR and API Gravity (from Steps 2 at each points) are examined to determine if any of these produce Tier 1 fits. The fit for the selected references are examined first (point 7). If this analysis produced a Tier 1 fit, the analysis is complete and the results are reported. If not, the process continues to point 8, and the fit based on crudes of the same grade(s) as the selected crudes using FT-IR and API Gravity are examined. The process continues checking fits for point 9 (crudes of same location(s)), point 10 (crudes of same region (s)), point 11 (all crudes) and point 12 (all crudes and contaminants), stopping if a Tier 1 fit is found or otherwise continuing. If not Tier 1 fit is found using FT-IR and API Gravity, FT-IR only fits (from Step 1 at each point) are examined, checking fits for point 13 (selected references), point 14 (same grades), point 15(same locations), point 16 (same regions), point 17 (all crudes) and point 18 (all crudes and contaminants), stopping if a Tier 1 fit is found or otherwise continuing.

If no Tier 1 fit is found, the analysis that produces the highest FQR value is selected and reported. If the FQR value is less than or equal to 1.5, the result is reported as a Tier 2 fit. Otherwise, it is reported as a failed fit.

If Viscosity data is not available, the analysis scheme would start at point 7 and continue as discussed above. If neither viscosity nor API gravity was available, the analysis scheme would start at point 15 and continue as discussed above.

If the function f(c,f,i) in [19] is not close to unity (e.g. the value of $\epsilon$ in [20] is for instance 0.25), then FQ will not necessarily decrease as more components are added to the blend, and analyses done with larger subsets of references may not produce lower FQ values. In this case, for the application of this invention to the prediction of crude assay data, a "Best Fit" scheme may yield more reasonable prediction quality.

If API gravity and viscosity data are both available, the analyses 1-6 of column 1 in FIG. 1 are evaluated, and the analysis producing the lowest FQR is selected as the best fit. If the FQR value for the best fit is less than 1, the analysis is complete and the results are reported.

If the best fit obtained using API Gravity and viscosity is not a Tier 1 fit, then the analyses 7-12 of column 2 in FIG. 1 are evaluated, and the analysis producing the lowest FQR is selected as the best fit. If the FQR value for the best fit is less than 1, the analysis is complete and the results are reported.

If the best fit obtained using API Gravity is not a Tier 1 fit, then the analyses 13-18 of column 3. in FIG. 1 are evaluated, and the analysis producing the lowest FQR is selected as the best fit. If the FQR value for the best fit is less than 1, the analysis is complete and the results are reported.

If none of the analyses produce a Tier 1 fit, then the analysis producing the lowest FQR value is selected and reported. If the FQR is less than 1.5, the results are reported as a Tier 2 fit, otherwise as a failed fit.

Library Cross Validation:

In order to evaluate and optimize the performance of a reference library, a cross validation procedure is used. In an iterative procedure, a reference is removed from the library and analyzed as if it were an unknown. The reference is then returned to the library. This procedure is repeated until each reference has been left out and analyzed once.

The cross validation procedure can be conducted to simulate any point in the analysis scheme. Thus for instance, the cross validation can be done using both API Gravity and viscosity as inspection inputs, and only using references from the same location as the reference being left out (simulation of point 3).

Reference Library Optimnization:

In order for the analyses for a given FQR to produce comparable assay predictions regardless of inspection inputs or reference subset selection, it is necessary to carefully optimize the FQC values and inspection weightings. This optimization can be accomplished in the following manner:

For FT-IR only analyses:

I. A minimum performance criteria is set.

II. For analyses conducted using FT-IR only, cross validation analyses are performed to simulate points 13-17 in the analysis scheme. The results for these points are combined, and the Fit Quality (FQ) is calculated for each result. Selected assay properties are predicted based on each fit.

III. The results are sorted in order of increasing Fit Quality (FQ).

IV. In turn, each FQ value is selected as a tentative FQC, and tentative FQR values are calculated. For each crude, a determination is made as to at which point (13-17) the analysis would have ended. The results corresponding to these stop points are collected, and statistics for the assay predictions are calculated. These results are referred to as the iterative results for this tentative FQC.

V. The maximum FQ value that meets the minimum performance criteria is selected as the $FQC_{IR}$.

VI. The iterative results from step IV are representative of the results that would be obtained from the analysis with the indicated FQC.

For analyses using FT-IR and inspections:

VII. A set of assay properties is selected for which the predictions are to be matched to those from the FT-IR only analyses.

VIII. Criteria for fit to the inspection data are set.

XI. An initial estimate is made for the inspection weights.

X. Cross validation analyses are performed to simulate points 1-5 or 7-11. The results for these points are combined and the Fit Quality (FQ) is calculated for each result. Selected assay properties are predicted based on each fit.

XI. The results are sorted in order of increasing Fit Quality (FQ).

XII. In turn, each FQ value is selected as a tentative FQC, and tentative FQR values are calculated. For each crude, a determination is made as to at which point (1-5 or 7-11) the analysis would have ended. The results corresponding to these stop points are collected, and statistics for the assay predictions are calculated. These results are referred to at the iterative results for this tentative FQC.

XIII. The statistics for the assay predictions made using the FT-IR and inspections are compared to those based on FT-IR only. The maximum FQ value for which the predictions are comparable is selected as the tentative $FQC_{IR,API}$ or $FQC_{IR,API,visc}$.

XIV. The fits to the inspection data are examined statistically and compared to the established criteria. If the statistics match the established criteria, then the tentative $FQC_{IR,API}$ or $FQC_{IR,API,visc}$ values are accepted. If not, then the inspection weightings are adjusted and 9-13 are repeated.

XV. The iterative results from step XII are representative of the results that would be obtained from the analysis with the indicated FQC and inspection weightings.

Various statistical measures can be used to evaluate the library performance and evaluate the fits to the inspections. These include, but are not limited to:

The standard error of cross validation for the prediction of the assay properties for Tier 1 fits. t(p,n) is the t statistic for probability level p and n degrees of freedom. The summation is calculated over the n samples that yield Tier 1 fits.

$$t \cdot SECV = t(p, n) \cdot \sqrt{\frac{\sum_{i=1}^{n} (\hat{y}_i - y_i)^2}{n}} \quad [27]$$

The confidence interval at FQR=1.

The percentage of predictions for Tier 1 fits for which the difference between the prediction and measured property is less than the reproducibility of the measurement.

Note that the fits for steps 6, 12 and 18 are not included in the library optimization since the reference crudes do not contain contaminants.

Calculation of Confidence Intervals:

For the inspections included in the fit, the confidence intervals (CI) are defined only in terms of the FQR. The following procedures is used to calculate confidence intervals for included inspections:

Absolute Error CI for inspections (e.g. API Gravity).

For each of the n iterative results from step XV above, calculate the difference between the inspection predicted from the fit, and the input (measured) inspection value, $$d_i = \hat{y}_i - y_i.$$

Divide the $d_i$ by $\sqrt{1-R_i^2}$.

Calculate the root mean of these scaled results.

$$s = \sqrt{\frac{\sum_{i=1}^{n} \frac{d_i^2}{(1 - R_i^2)}}{n}}.$$

Calculate the t value for the desired probability level and n degrees of freedom.

The Confidence Interval is then given by equation [25].

Relative Error CI for inspections (e.g. viscosity).

For each of the n iterative results from step XV above, calculate the relative difference between the inspection predicted from the fit, and the input (measured) inspection value, $$r_i = \frac{\hat{y}_i - y_i}{\hat{y}_i + y_i/2}.$$

Divide the $r_i$ by $\sqrt{1-R_i^2}$.

Calculate the root mean of these scaled results, $$s = \sqrt{\frac{\sum_{i=1}^{n} \frac{r_i^2}{(1 - R_i^2)}}{n}}.$$

Calculate the t value for the desired probability level and n degrees of freedom.

The Confidence Interval is then given by equation [26].

Absolute Error for Assay Predictions:

The estimation of the a and b parameters are made using all of the results from the cross-validation analysis (points 1-5, points 7-11 or points 13-17).

For each of the m results from the cross validation analysis, calculate the difference, $d_i$, between the predicted and measured assay property value; $d_i = \hat{y}_i - y_i$.

For an initial estimate of a and b, calculate $$\delta_i = \sqrt{FQR^2 + \left(a + b\left(\frac{\hat{y}_i + y_i}{2}\right)\right)^2}$$

for each of the m results.

For each result, calculate the ratio $d_i/\delta_i$.

For the distribution of the m ratios, calculate a statistic that is a measure of the normality of the distribution. Such statistics include, but are not limited to the Anderson-Darling statistic, and the Lilliefors statistic, the Jarque-Bera statistic or the Kolmogorov-Smirnov statistic. The values of a and b are adjusted to maximize the normality of the distribution based on the calculated normality statistic. For the Anderson-Darling statistic, this involves adjusting a and b so as to minimize the statistic.

For each of the n iterative results, calculate the difference, $d_i$, between the predicted and measured assay property value; $d_i = \hat{y}_i - y_i$.

Using the a and b values determined above, calculate $$\delta_i = \sqrt{FQR^2 + \left(a + b\left(\frac{\hat{y}_i + y_i}{2}\right)\right)^2}$$

for each of the n iterative results.

Calculate the root mean of the scaled differences, $$s = \sqrt{\frac{\sum_{i=1}^{n} \left(\frac{d_i}{\delta_i}\right)^2}{n}}.$$

Calculate the t statistic for the desired probability level and n degrees of freedom.

The Confidence Interval is then given by equation [23].

If the reproducibility of the reference property measurement is independent of level, the parameter b may be set to zero and only the parameter a is adjusted.

Other, more complicated expressions could be substituted for $f(E_{ref})$, and optimized in the same fashion as described above. For example, for methods with published reproducibilities, $f(E_{ref})$ could be expressed in the same functional form as the published reproducibility.

Relative Error for Assay Predictions:

The estimation of the a parameters is made using all of the results from the cross-validation analysis (points 1-5, points 7-11 orpoints 13-17).

For each of the m results from the cross validation analysis, calculate the relative difference, $r_i$, between the predicted and measured assay property value;

$$r_i = \frac{\hat{y}_i - y_i}{(\hat{y}_i + y_i)/2}.$$

For an initial estimate of a and b, calculate $\delta_i = \sqrt{FQR^2 + a^2}$ for each of the m results.

For each result, calculate the ratio $d_i/\delta_i$.

For the distribution of the m ratios, calculate a statistic that is a measure of the normality of the distribution. Such statistics include, but are not limited to the Anderson-Darling statistic, and the Lilliefors statistic, the Jarque-Bera statistic or the Kolmogorov-Smirnov statistic. The values of a and b are adjusted to maximize the normality of the distribution based on the calculated normality statistic. For the Anderson-Darling statistic, this involves adjusting a and b so as to minimize the statistic.

For each of the n iterative results, calculate the relative difference, $r_i$, between the predicted and measured assay property value;

$$r_i = \frac{\hat{y}_i - y_i}{(\hat{y}_i + y_i)/2}.$$

Using the a and b values determined above, calculate $\delta_i = \sqrt{FQR^2 + a^2}$ for each of the n iterative results.

Calculate the root mean of the scaled differences, $$s = \sqrt{\frac{\sum_{i=1}^{n}\left(\frac{d_i}{\delta_i}\right)^2}{n}}.$$

Calculate the t statistic for the desired probability level and n degrees of freedom.

The Confidence Interval is then given by equation [23].

If the reproducibility of the reference property measurement is independent of level, the parameter b may be set to zero and only the parameter a is adjusted.

Other, more complicated expressions could be substituted for $f(E_{ref})$, and optimized in the same fashion as described above. For example, for methods with published reproducibilities, $f(E_{ref})$ could be expressed in the same functional form as the published reproducibility.

What is claimed is:

1. A method for the determination of optimal operation for a given crude oil feedstream of a refinery pipestill by determining a virtual assay of said crude oil feed comprising:

a) feeding a crude oil feedstream into said refinery pipestill wherein said crude oil feedstream is separated into boiling range fractions and determining the yields of the boiling range fractions.

b) performing a virtual assay of said crude oil feedstream by the steps in c, d and e, c) determining an IR spectrum of said crude oil feedstream, d) fitting said IR spectrum to a linear combination of known IR spectra in a database to determine the coefficients of the linear combination, wherein the database includes IR spectra of reference crude oils whose boiling range fraction yields are known, e) determining the boiling point fractions yields of said crude oil feedstream from the coefficients of the linear combination and the boiling range fraction yields of the reference crudes, f) comparing the predicted boiling range fraction yields with the actual boiling range fraction yields from the pipestill to determine differences between these fraction yields, g) relating said difference between the fraction yields with the optimal operation of the refinery pipestill for the crude oil feedstream.

2. The method of claim 1 wherein said Virtual Assay is performed using a FT-IR spectrum and API gravity of the crude oil feedstream.

3. The method of claim 1 wherein said Virtual Assay is performed using a FT-IR spectrum, API gravity and viscosity of the crude oil feedstream.

4. The method of claim 1 wherein the virtual assay is performed on a sample of crude oil taken from an inlet line to the pipestill.

5. The method of claim 1 wherein the virtual assay is performed on a sample of crude oil taken from a well-mixed tank of crude oil that feeds an inlet line to the pipestill.

6. The method of claim 1 wherein the virtual assay is performed on an all-levels sample of crude oil taken from a nonhomogeneous tank of crude oil that feeds an inlet line to the pipestill.

7. The method of claim 1 wherein the virtual assay is performed on samples taken from more than one well-mixed tanks of crude oil that feed an inlet line to the pipestill.

8. The method of claim 1 further comprising the step of eliminating crude variability as the source of deviations in pipestill operation.

* * * * *